United States Patent [19]

Pottorff

[11] Patent Number: 4,877,233

[45] Date of Patent: Oct. 31, 1989

[54] ROTARY VACUUM WICKETTER

[76] Inventor: Earl T. Pottorff, 2346 Taylor Rd., Savannah, N.Y. 13146

[21] Appl. No.: 248,134

[22] Filed: Sep. 23, 1988

[51] Int. Cl.[4] ..... B65H 29/24

[52] U.S. Cl. ..... 271/196; 271/108; 414/27

[58] Field of Search ..... 271/194, 196, 903, 94, 271/108; 414/793, 27

[56] References Cited

U.S. PATENT DOCUMENTS

| | | | |
|---|---|---|---|
| 3,921,827 | 11/1975 | Joice | 271/196 X |
| 4,606,537 | 8/1986 | Achelpohl | 271/196 |
| 4,668,148 | 5/1987 | Sample | 271/196 X |

*Primary Examiner*—Richard A. Schacher

*Attorney, Agent, or Firm*—Wall and Roehrig

[57] ABSTRACT

A rotary vacuum wicketting device has a stationary hub and a rotary hub that has a number of vacuum arms to carry plastic bags or similar workpieces from a first work station to a second work station where they are placed on a wicket. The rotary and stationary hubs are both molded of a plastic synthetic resin which has been filled with a suitable lubricating agent. The radial arms are also formed of the plastic synthetic resin and are molded to have a square cross section from the radially outward end to and including the male portion that fits into a square cross section socket in the peripheral wall of the rotating hub. The tubular arms have a removable end cap to facilitate cleaning debris that may have collected inside the arms. A removable plastic wear plate is carried on the forward-facing surface of each of the arms to absorb wear and abrasion from action of the plastic film workpieces.

15 Claims, 2 Drawing Sheets

ROTARY VACUUM WICKETTER

BACKGROUND OF THE INVENTION

This invention relates to apparatus for handling plastic film articles, and is more particularly directed to apparatus known as a vacuum wicketter, which picks up film articles such as plastic bags on a manufacturing line, and rotates to carry the same to a station where the plastic bags are placed on a wicket. Vacuum is applied to arms of the rotating wicketter at least from the pickup work station to the wicketting work station.

A conventional vacuum wicketter is of aluminum construction, having a two-part hub assembly and a plurality of vacuum arms. The hub assembly has a lower stationary part and an upper rotating part. Both of these are typically of cast aluminum. A bearing mounted on the lower stationary part permits rotation of the superposed upper rotating part. One or more vacuum lines are connected to the stationary hub part, and these connect to a semi-circular channel that is open on the upper surface of the stationary part.

The rotating hub part carries the vacuum arms which radiate from its circumference at an even spacing. Typically, there are eight arms spaced at 45 degrees. L-shaped passages in the rotating hub part have one end open to the circumference, which serves as a socket for the male end of the arm, and the other end open to the lower surface to communicate with the vacuum channel in the stationary part. This ensures that vacuum is applied while the respective arms rotate over an angular sector corresponding to the travel between the pickup station and the wicketting work station.

The arms are typically of aluminum and generally with a square or rectangular cross section. On each arm, the surface that faces in the direction of rotation has an elongated vacuum channel and a number of apertures or perforations to permit the arm to pick up and carry the plastic bag or other film articles. There is also typically a ceramic coating on this surface to withstand wear from friction of the plastic film against the arm.

However, with this construction there are a number of ensuing problems which can lead to break-downs or to long outages for maintenance. These problems arise largely because of plastic debris and dust which is sucked by the vacuum into the tubular arm, and which can accumulate and clog the apparatus.

The male portions of the wicketter arms have a circular cross section to fit into the sockets which are machined or drilled into the rotating hub portion. However, the remainder of the arm is of square or rectangular cross section. There are blind pockets where the circular and square cross-sectional portions meet, and these provide sites for collecting the plastic dust and debris. This matter quickly builds up and eventually will clog the arm, so that it will not operate as intended.

These tubular aluminum arms invariably have a plate that is either welded on or formed unitarily at the outer end of the arm, and which closes it off. Therefore, in order to clean dust and debris from the arm, it is necessary to remove the entire arm from the rotor hub. This takes considerable time and skill.

Furthermore, the ceramic surface on the aluminum arms eventually will wear off. At that point, the entire arm has to be removed and replaced, with the original arm being sent out for resurfacing. This is a rather expensive process, and there is significant down time for the arms to be removed and replaced.

Still another drawback with the conventional wicketter is that the two-part hub requires an additional bearing member between the stationary and rotating hub portions. This bearing can wear out, and it is difficult and time consuming job to replace it.

OBJECTS AND SUMMARY OF THE INVENTION

Accordingly, it is one object of this invention to provide an improved vacuum wicketter which avoids the aforementioned drawbacks of the prior art.

It is another object of this invention to provide a vacuum wicketter in which the vacuum arms are so constructed as to minimize clogging due to sucked-in dust and debris.

It is yet another object of this invention to provide a vacuum wicketter in which access is provided to the arms for cleaning purposes without removing the arms from the remainder of the device.

It is a further object of this invention to provide wear plates for the vacuum arms to eliminate the need for conventional ceramic coating.

It is a still further object of this invention to provide a vacuum wicketter which avoids the need for a separate bearing member between the upper and lower hub portions.

In accordance with an aspect of this invention, rotary vacuum wicketter apparatus is provided for picking up and carrying flat film workpieces from a first work station to place the workpieces on a wicket at a second work station. A vacuum hub assembly is formed of a stationary hub and a rotary hub superimposed on one another with the same horizontal axis. The stationary hub has a vacuum channel permitting vacuum to be applied over a predetermined angular portion of the superposed rotary hub. The rotary hub has a circular or axial surface facing an upper surface of the stationary hub, and has a plurality of spaced sockets in its circumferential or peripheral surface and which also penetrate to the axial surface to communicate with the vacuum channel. A plurality of radial arms are mounted in the rotary hub, and project radially outward from it. Each of the arms is in the form of a tube that is closed at its radially outward end, and with a male portion at its radially inward end which fits into a respective one of the rotary hub sockets. Each arm has a flat longitudinal face situated on the side that faces in the rotation direction. This face is provided with perforations through it so that the arm can pick up and carry the workpieces by vacuum from the first work station to the second work station.

This vacuum wicketting apparatus has a number of features which constitute improvements over the conventional wicketter as described above.

In the wicketting apparatus of this invention, each arm is of a uniform internal cross section from the radial outward end to and including the male portion, so that blind pockets are avoided. This minimizes the likelihood for dust to accumulate within the arm. The sockets are likewise provided with an internal shoulder having a stepped distance that substantially equals the tube thickness. This also provides a smooth flow surface, avoiding points for the dust and debris to accumulate.

The upper hub, the lower hub, and the arms are all preferably molded from a semi-rigid plastic synthetic resin, such as Delrin, which is an acetal homopolymer.

This material is preferably impregnated with a lubricating agent, so that a portion of the upper and lower hubs can itself serve as a bearing surface, thereby avoiding the need for a separate bearing. In addition, the lubricant-impregnated plastic arms sustain the abrasion and wear from the plastic film workpieces much better than does ceramic-clad aluminum. The arms are each provided with a removable end cap, which permits access to the tubular arm without removal of the arm from the hub. Also, each of the arms includes a removable flat wear plate attached onto its flat longitudinal forward-facing surface. The wear plate extends radially over a major portion of the length of the arm, and absorbs wear caused by frictional contact with the workpieces. The wear plate can be removed and replaced quickly, without removal of the arm from the rotary hub.

The above and many other objects, features, and advantages of this invention will be more fully understood from the ensuing description of a preferred embodiment, when read in connection with the accompanying Drawing.

DETAILED DESCRIPTION OF THE PREFERRED EMBODIMENT

Figure 1:
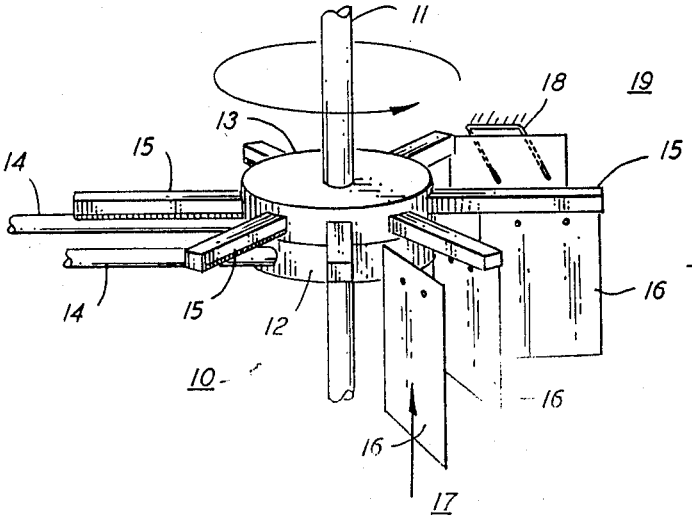
FIG. 1 is a perspective view of a vacuum wicketting device according to this invention.

With reference to the Drawing, and initially to FIG. 1, a conventional vacuum wicketting device 10 has a rotating shaft 11 which passes through an opening in a stationary hub 12 and rotates rotating hub 13. The shaft can be disposed horizontally or vertically depending on the manufacturing design. Vacuum lines 14 connect to appropriate ports in the lower hub 12. A plurality of arms 15 radiate outward from the rotating hub and as these arms 15 rotate, they pick up plastic polyethylene film bags 16 from a pickup station 17 and place them on a wicket 18 at a second station 19. The arms 15 carry the plastic bags or other articles by vacuum from the first work station 17 to the second work station 19.

Figure 2:
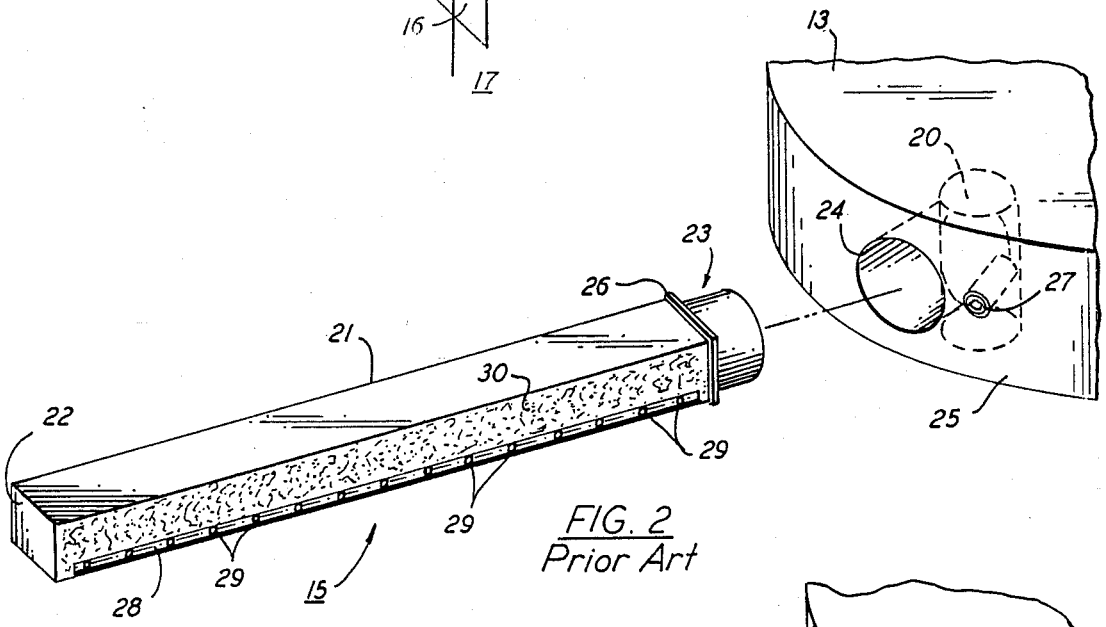
FIG. 2 Prior Art
FIG. 2 is a perspective view of a portion of conventional wicketting apparatus.

In a conventional wicketting device, as shown in more detail in FIG. 2, the hubs are typically cast aluminum and have L-shaped cavities 20 milled into them to provide a vacuum communication channel between the arms 15 and the vacuum channel in the stationary hub 12.

The arm 15 has a main tubular outer section 21 that is square or rectangular in cross-section. An end plate 22 is permanently affixed on the outer end of the arm 15 to close it off. The arm 15 has a male portion 23 of round cross-section at the radially inward end thereof, and this male portion 23 fits into a round socket 24 or female receptacle, which is a portion of the cavity 20 in the rotating hub 13. The sockets 24 are disposed at spaced intervals around the circumferential wall 25 of the rotating hub 13. A flange 26 extends around the arm 15 at the juncture of the square-cross-section main portion 21 and the circular-cross-section male portion 23. A hold down (not shown) fits over this flange 26 and fastens to a threaded bore 27 adjacent the socket 24 to hold the arm 15 in place.

The main portion 21 of the arm 15 has a vacuum channel 28 situated along one face of the arm that faces forward, i.e., in the direction of rotation. Openings 29 are provided at intervals along this channel 28 to allow vacuum from inside of the tubular arm 15 to enter the channel 28 so that the arm 15 can pick up the bags 16 by vacuum. A ceramic layer 30 is coated on this forward surface of the arm 15 to withstand wear and abrasion from movement of the plastic film across this surface.

These arms 15 are typically cast and welded aluminum, and are rather expensive to replace.

As can be easily appreciated, where the square-cross section portion 21 and the round-cross-section portion 23 meet, blind pockets are formed on the inside of the tubular arm 15. These serve as locations where plastic dust and debris that is sucked in through the openings 29 will tend to collect, and this dust and debris will eventually fill the inside of the arm 15.

When the arm is to be cleaned, the entire arm 15 must be removed from the hub 13. There is a risk that a workman might drop and damage the arm. Also, the necessity to remove the arm 15 from the apparatus makes cleaning a tedious and time consuming chore. Also, when the ceramic coated surface 30 becomes worn, it is necessary to remove the entire arm 15 and replace it.

Figure 3:
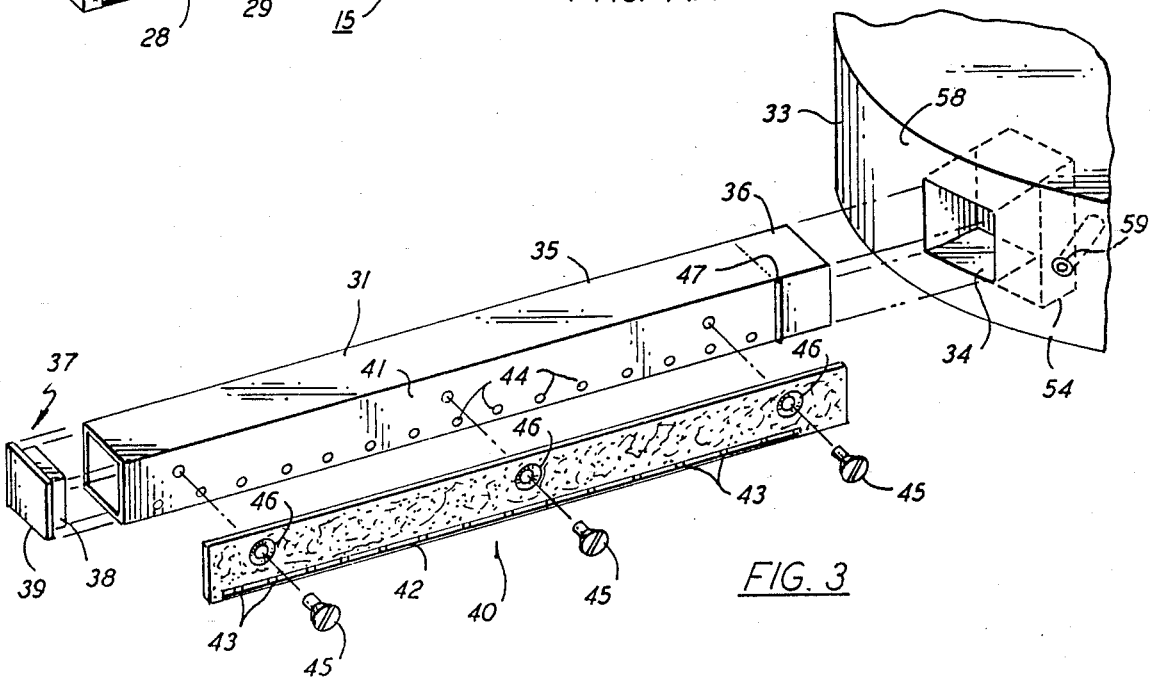
FIG. 3 is a perspective view of a portion of the wicketting apparatus according to a preferred embodiment of this invention.

The improvement features of this invention can be appreciated with reference initially to FIG. 3, which illustrates vacuum wicketting device 31 according to the present invention. In the device 31 of this embodiment, a rotating hub 33 is molded from a suitable plastic synthetic resin. The hub 33 is provided with sockets 34 of square cross section into which are fitted tubular plastic vacuum arms 35. A typical arm 35 is shown here to be of a uniform square cross section, including a male portion 36 which fits into the square-cross-sectional socket 34. The arm 35 has a removable end cap 37, which can be held in place by a set screw (not shown). Here the end cap 37 has a square inner plug portion 38 which fits snugly into the square cavity at the end of the arm 35, and an outer end flange 39.

The arm 35 also carries a removable wear plate 40, of substantially the same width as a forward-facing surface 41 of the arm. This wear plate 40 extends radially along a major part of the length of the arm 35. A channel 42 is formed along a lower edge of the wear plate 40 and has a number of openings 43 which overlie vacuum openings 44 in the pickup arm 35 behind it. The wear plate 40 is held to the arm 35 by suitable fastening means: in this case, flathead machine screws 45 fit into countersunk openings in the wear plate 40 and screw into threaded bores or receptacles in the forward surface 41. Also shown in FIG. 3, a protuberance 47 on the forward side of the arm 35 serves as a ledge for a hold-down clamp (not shown).

Figure 4:
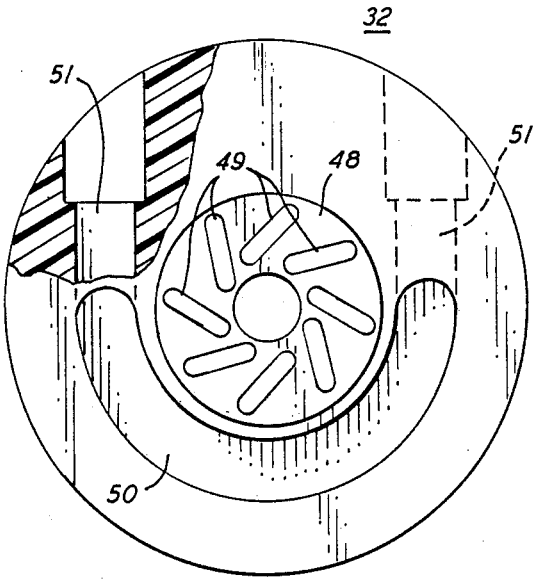
FIG. 4 is a top plan view of the stationary hub of the preferred embodiment.
Figure 5:
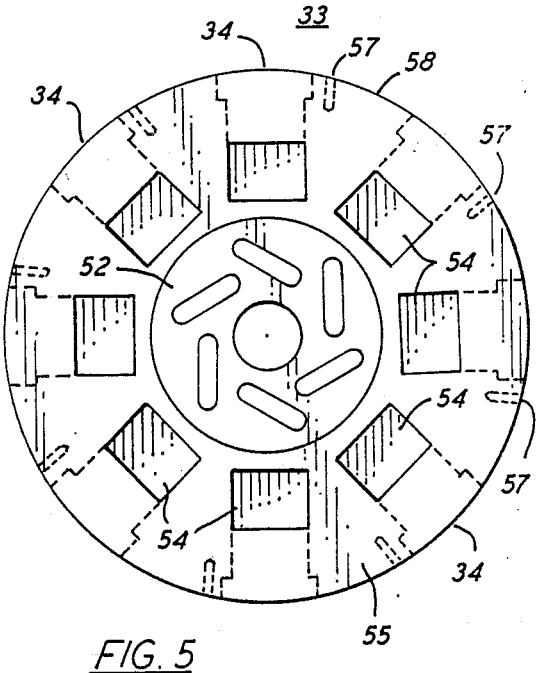
FIG. 5 is a lower plan view of the rotating hub of the preferred embodiment.

With reference to FIGS. 4 and 5, a stator hub 32 and the rotor hub 33 are each formed by molding them unitarily from a plastic synthetic resin. In the preferred embodiment, this resin can be Delrin, which is an acetal homopolymer. This material is preferably impregnated with a lubricating agent, which gives it advantageous characteristics to be described shortly.

Figure 6:
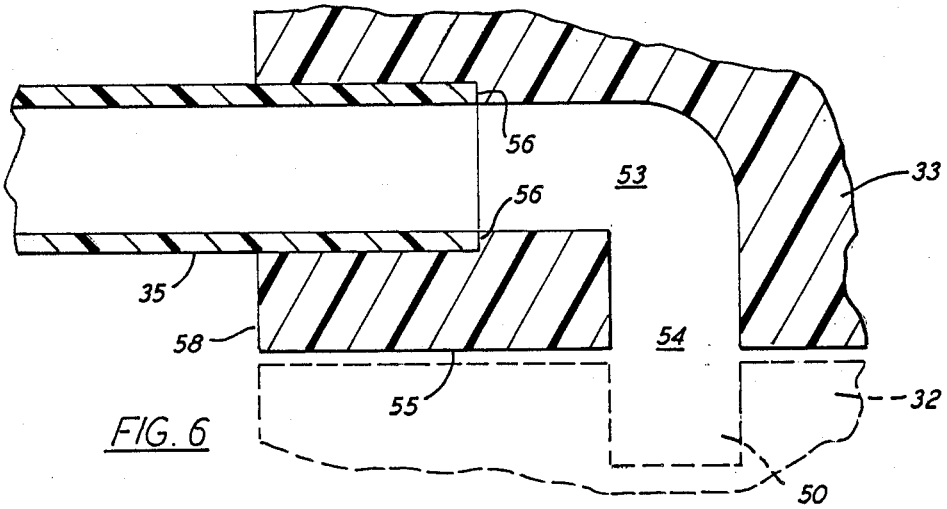
FIG. 6 is a cross sectional view of a portion of the rotary hub and arm of the preferred embodiment.

A bearing portion 48 is formed on the radially inner part of the stationary hub 32 and this has a number of cutouts 49 therein to reduce its surface area. A semi-circular vacuum channel 50 is formed in the stator hub 32, and ducts 51 connect ends of the channel 50 to the vacuum lines 14. The semi-circular vacuum channel 50 is open at the upper surface of the hub 32 so that it can communicate through openings in the rotor hub 33 with the pickup arms 35. The rotor hub 33 also has a central bearing portion 52 on its lower surface and this bearing portion 52 faces against the bearing portion 48 of the stator hub 32. These two portions 48, 52 being unitarily formed with the respective hubs 32, 33 avoid the need for an additional bearing between the rotor stator members. As shown in FIG. 5 and in FIG. 6, each of the sockets 34 leads into an L-shaped passage 53 which is of a square cross section, with a square cross sectional portion 54 being directed downward to a lower surface 55 of the rotor hub 32. Here the L-shaped passage communicates with the semi-circular vacuum channel 50. The socket 34 ends at a shoulder 56 in the L-shaped passage 53, and this shoulder has a step width that is substantially equal to the wall thickness of the associated pickup arm 35. This arrangement avoids any abrupt shape change throughout the arm 35 and the socket 34, thereby further lessening the possibilities for dust and debris to collect within the arm 35. As also shown in FIG. 5, there are threaded bores 57 provided in the cylindrical peripheral surface 58 of the rotor hub 33 substantially adjacent the sockets 34. These bores 57 facilitate connection of suitable hold down members.

Figure 7:
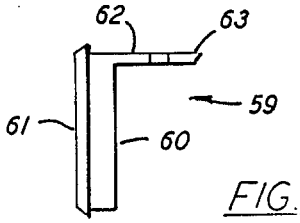
FIG. 7 illustrates an alternative end cap that can be employed with embodiments of this invention.

An alternative end cap 59 is shown in FIG. 7. This can be used in place of the end cap 37 of FIG. 3. This cap 59 also has a square plug 60 fitting into the open end of the arm 35 and an outer flange 61. There is also a semi-rigid, resilient finger 62 that projects inwardly along one wall of the arm 35. A protuberance 63 at the end of the finger 62 fits into a hole or recess (not shown) in that wall of the arm 35.

While this invention has been described in detail with reference to a preferred embodiment, it should be understood that the invention is not limited to that embodiment. Rather, many modifications and variations could be carried out by those skilled in the art without departing from the scope and spirit of this invention, and as defined in the appended claims.

What is claimed is:

1. Rotary vacuum pickup apparatus for carrying flat workpieces from a first work station and placing the workpieces on a wicket at a second work station; comprising a vacuum hub assembly formed of a stationary hub and a rotary hub superposed on one another and having a common axis, the stationary hub including vacuum channel means for applying vacuum over a predetermined angular portion of the superposed rotary hub, and the rotary hub having a peripheral surface, an axial surface in communication with the vacuum channel means of the stationary hub, and a plurality of spaced sockets which penetrate to said axial surface to communicate with said vacuum channel means; and a plurality of radial arms mounted in the rotary hub and projecting radially outward therefrom, each said arm being a tube closed at its radial outward end, having a male portion at its radial inward end which fits into a respective one of said sockets, and having a flat longitudinal face on the side that faces in the rotation direction of said rotary hub and which is provided with perforations therethrough so that the arm can carry said workpieces by vacuum from the first work station to said second work station; comprising the improvement herein each said arm is of uniform internal cross section from the radial outward end to and including the male portion, so that blind pockets are avoided where dust might accumulate.

2. The rotary vacuum pickup apparatus of claim 1 wherein said arm has a uniform square internal cross section, and said sockets are of square cross section at said peripheral surface.

3. The rotary vacuum pickup apparatus of claim 2 wherein said sockets each comprise an L-shaped cavity having a square cross-section portion to communicate with the vacuum channel means.

4. The rotary vacuum pickup apparatus of claim 2 wherein said sockets have an internal shoulder with a step distance substantially equal to the wall thickness of the associated arm.

5. The rotary vacuum pickup apparatus of claim 1 wherein said arms are molded of a plastic synthetic resin.

6. Rotary vacuum pickup apparatus for carrying flat workpieces from a first work station and placing the workpieces on a wicket at a second work station; comprising a vacuum hub assembly formed of a stationary hub and a rotary hub superposed on one another and having a common axis, the stationary hub including vacuum channel means for applying vacuum over a predetermined angular portion of the superposed rotary hub, and the rotary hub having a peripheral surface, an axial surface in communication with the vacuum channel means of the stationary hub, and a plurality of spaced sockets which penetrate to said axial surface to communicate with said vacuum channel means; and a plurality of radial arms mounted in the rotary hub and projecting radially outward therefrom, each said arm being a tube closed at its radial outward end, having a male portion at its radial inward end which fits into a respective one of said sockets, and having a flat longitudinal face on the side that faces in the rotation direction of said rotary hub and which is provided with perforations therethrough so that the arm can carry said workpieces by vacuum from the first work station to said second work station; comprising the improvement wherein said arms each include a removable end cap closing off the radially outward end thereof, and which is removable to permit cleaning the interior of the arm without removing the arm from the rotary hub.

7. The rotary vacuum pickup apparatus of claim 6 wherein said end cap is molded of a synthetic resin material.

8. Rotary vacuum pickup apparatus for carrying flat workpieces from a first work station and placing the workpieces on a wicket at a second work station; comprising a vacuum hub assembly formed of a stationary hub and a rotary hub superposed on one another and having a common axis, the stationary hub including vacuum channel means for applying vacuum over a predetermined angular portion of the superposed rotary hub, and the rotary hub having a peripheral surface, an axial surface in communication with the vacuum channel means of the stationary hub, and a plurality of spaced sockets which penetrate to said axial surface to communicate with said vacuum channel means; and a plurality of radial arms mounted in the rotary hub and projecting radially outward therefrom, each said arm being a tube closed at its radial outward end, having a male portion at its radial inward end which fits into a respective one of said sockets, and having a flat longitudinal face on the side that faces in the rotation direction of said rotary hub and which is provided with perforations therethrough so that the arm can carry said workpieces by vacuum from the first work station to said second work station; wherein each said arm further includes a removable flat wear plate attached onto said flat longitudinal face of said arm and which extends radially over a major portion of the length thereof for absorbing wear caused by frictional contact with the workpieces, and means permitting removal and replacement of the wear plate onto said longitudinal face of the associated arm without removal of the arm from the rotary hub.

9. The rotary vacuum pickup apparatus of claim 8 wherein said wear plate extends across the width of the longitudinal surface of the arm.

10. The rotary vacuum pickup apparatus of claim 9 wherein said wear plate has a plurality of perforations therethrough which match the perforations in the longitudinal face of the associated arm.

11. The rotary vacuum pickup apparatus of claim 8 wherein said means permitting removal and replacement include a plurality of screw fasteners which penetrate the wear plate and enter threaded receptacles in the arm.

12. The rotary vacuum pickup apparatus of claim 8 wherein said wear plate is formed of a plastic synthetic resin material that is impregnated with a lubricating agent.

13. Rotary vacuum pickup apparatus for carrying flat workpieces from a first work station and placing the workpieces on a wicket at a second work station; comprising a vacuum hub assembly formed of a stationary hub and a rotary hub superposed on one another and having a common axis, the stationary hub including vacuum channel means for applying vacuum over a predetermined angular portion of the superposed rotary hub, and the rotary hub having a peripheral surface, an axial surface in communication with the vacuum channel means of the stationary hub, and a plurality of spaced sockets which penetrate to said axial surface to communicate with said vacuum channel means; and a plurality of radial arms mounted in the rotary hub and projecting radially outward therefrom, each said arm being a tube closed at its radial outward end, having a male portion at its radial inward end which fits into a respective one of said sockets, and having a flat longitudinal face on the side that faces in the rotation direction of said rotary hub and which is provided with perforations therethrough so that the arm can carry said workpieces by vacuum from the first work station to said second work station; comprising the improvement wherein said stationary hub, said rotary hub, and said arms are each molded of a semi-rigid plastic synthetic resin material which has been impregnated with a lubricating agent.

14. The rotary vacuum pickup apparatus of claim 13 in which said arms each have a uniform square internal cross section from the radial outer end to and including the male portion thereof, and said sockets also have similar square cross sections, so that blind pockets are avoided where debris from said workpieces might accumulate.

15. The rotary vacuum pickup apparatus of claim 13 in which said stationary and rotary hubs have integrally formed facing bearing portions formed respectively therein.

* * * * *